United States Patent [19]

Takada et al.

[11] 4,379,702

[45] Apr. 12, 1983

[54] INTAKE DUCT FOR AN OUTBOARD ENGINE

[75] Inventors: Yukimitsu Takada; Hiroshi Harada, both of Shizuoka; Shuji Takubo, Hamamatsu, all of Japan

[73] Assignee: Yamaha Hatsudoki Kabushiki Kaisha, Iwata, Japan

[21] Appl. No.: 222,559

[22] Filed: Jan. 5, 1981

[30] Foreign Application Priority Data

Jan. 10, 1980 [JP] Japan ..... 55-1527

[51] Int. Cl.[3] ..... B63H 21/26

[52] U.S. Cl. ..... 440/77; 123/195 P

[58] Field of Search ..... 114/211, 334; 440/88, 440/89, 77; 180/69.1, 69 R, 69.01; 123/195 P, 198 E, 195 O; 55/185, 192

[56] References Cited

U.S. PATENT DOCUMENTS

| | | | |
|---|---|---|---|
| 1,381,394 | 6/1921 | Bloodgood | 180/69.01 |
| 2,881,860 | 4/1959 | Ternes | 180/69 R |
| 3,195,530 | 7/1965 | Heidner | 440/77 |
| 3,610,198 | 10/1971 | Alexandrowicz | 440/77 |
| 4,019,456 | 4/1977 | Harbert | 440/88 |

*Primary Examiner*—Charles E. Frankfort
*Assistant Examiner*—Thomas J. Brahan
*Attorney, Agent, or Firm*—Donald D. Mon

[57] ABSTRACT

An intake duct for an outboard engine. A cowling atop the engine forms, with a top cover plate, a recess which opens rearwardly. Intake parts are formed at the right and left sides of this recess, near the upper elevation thereof, in the vicinity of the cover plate. This provides for air flow in such a way as tends to remove, in the recess, water which is entrained in the air stream, before the air flows out of the intake ports to the engine.

6 Claims, 5 Drawing Figures

INTAKE DUCT FOR AN OUTBOARD ENGINE

FIELD OF THE INVENTION

This invention relates to air intake ducts for outboard engines of the type used on boats.

BACKGROUND OF THE INVENTION

The air intake of an outboard engine is generally through an intake duct which is disposed at the rear of a cowling. However, water spray splashed during navigation may enter with the intake air, so that the water is sucked into the engine or wets electric equipment of the engine thereby to cause engine trouble. In order to eliminate this trouble, there has been proposed a construction, for example, in which the rear recess of the cowling is formed at its center portion with a generally upright intake port having a cylindrical shape. According to this construction, however, since the air sucked into the cowling through the cylindrical intake port will flow substantially in a vertically downward direction, it directly impinges upon the engine body and the electric equipment. Consequently, if water is entrained in the air stream, the engine body and the electric equipment may be wetted with the water. Thus, this prior art construction has failed to solve the aforementiond problem in a perfect manner.

It is therefore an object of the present invention to eliminate the drawback concomitant with the aforementioned prior art and to provide an outboard engine intake duct which can reduce the entry of water into the cowling and which can discourage the water, if it has entered, from wetting the engine and the electric equipment, and from reaching the intake system of the engine itself.

BRIEF DESCRIPTION OF THE INVENTION

An outboard engine intake duct according to this invention includes a cowling atop an engine which forms, with a cover plate, a recess which opens rearwardly. Intake ports are formed at the left and right sides of the recess, and lead to the air induction system of the engine. They are formed near the upper elevation of the recess, near the cover plate. This provides for air flow in such a way as tends to remove, in the recess, water that is entrained in the air stream, before the air flows out of the intake ports to the engine.

According to a preferred but optional feature of the invention, the intake ports may be provided with baffles.

The above and other features of the invention will be fully understood from the following detailed description, and the accompanying drawings, in which:

DETAILED DESCRIPTION OF THE INVENTION

Figure 1:
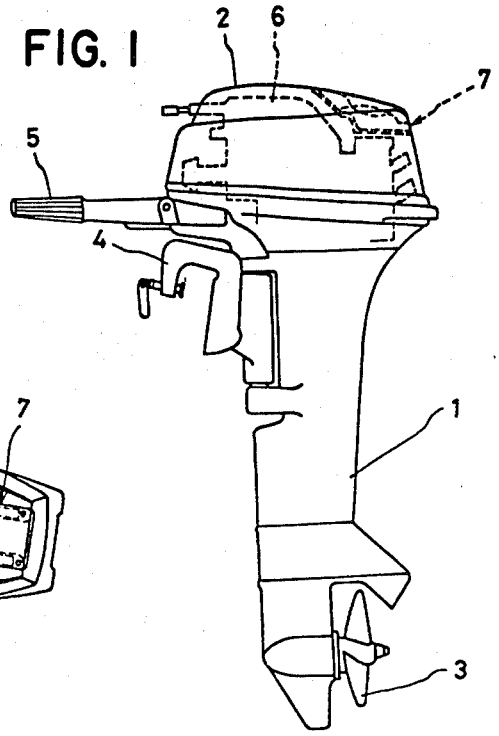
FIG. 1 is a side elevation showing an outboard engine equipped with an intake duct according to the present invention.
Figure 2:
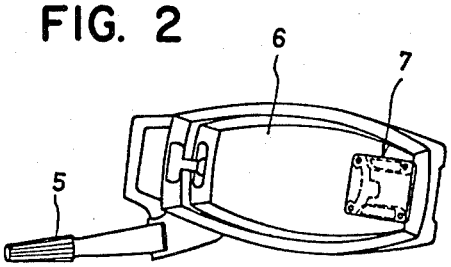
FIG. 2 is a top plan view showing the same outboard engine.

Indicated at reference numeral 1 in FIGS. 1 and 2 is a casing, above which a cowling 2 is disposed and below which a screw propeller 3 is located. Numeral 4 indicates a bracket for mounting casing 1 to the hull. Numeral 5 indicates a handle. An engine and its electric equipment 6 are accommodated in the cowling 2, and an intake duct 7 is disposed in the upper rear portion of cowling 2.

Figure 3:
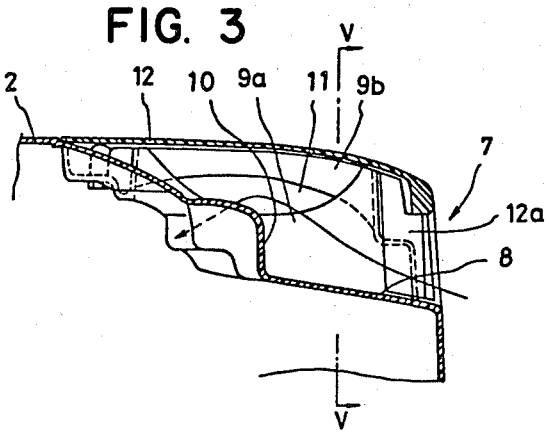
FIG. 3 is a fragmentary longitudinal section taken in FIG. 1.
Figure 4:
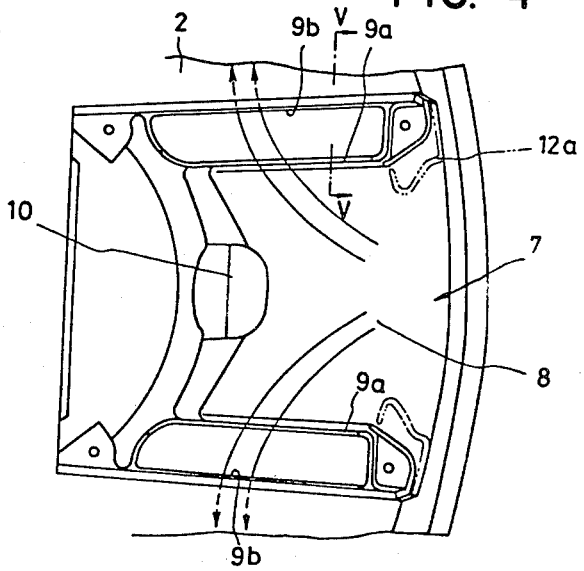
FIG. 4 is a top plan view showing the duct with its cover plate removed.
Figure 5:
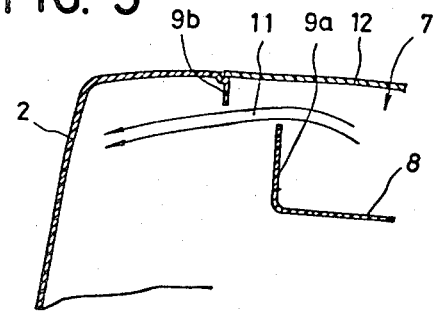
FIG. 5 is a section viewed in the direction of line V—V in FIGS. 3 and 4.

FIGS. 3 to 5 show in detail intake duct 7, which is so disposed at the upper rear portion of cowling 2, and forms a recess. This recess is defined by a bottom 8, by a dual construction of inner and outer walls **9*a* and 9*b* at both right and left sides, and by a back 10. Back 10 is disposed at the opposite extremity of the recess from the rear open end of duct 7. Its center portion protrudes and is inclined toward both of side walls 9*a* and 9*b*. The upper portion of inner wall 9*a* and the lower portion of outer wall 9*b* are arcuately cut away at both sides to form an intake port 11 at each side. The cut portions partially coextend with each other, as shown in side view. The upper opening of the recess is covered by a cover plate 12. Cover plate 12 is formed at both sides at the rear end with throttle portions 12*a*, by which the air intake passage is constricted when it is mounted to the cowling, as indicated in double-dotted lines in FIG. 4. As shown therein, throttle portions reduce the width of duct 7** at the inlet end.

In an intake duct 7 with the construction thus far described, the air sucked through the rear opening expands after it has been throttled through a reduced section by portions **12*a*, and then is divided at the center protrusion of back 10 into right and left air flows. These air flows are turned toward the walls 9*a* and 9*b* at the sides. When the air is thus divided into two flows, water, having a larger inertia, fails to sufficiently follow the change of direction of the air flows, and impinges onto and wets back 10. As a result, a considerable quantity of entrained water will be removed from the air flow which flows into the cowling 2 through the intake port 11 formed by the cut portions of the walls 9*a* and 9*b*** at both sides.

Also, air sucked from the intake port 11 into the cowling 2 flows substantially in a horizontal direction, as shown in FIG. 5, and impinges upon the inner faces of parts **2*a* of cowling 2, in this case the downwardly-extending outer wall. As a result, such water as may still be entrained will flow down the inside wall surfaces of the cowling, and thereby is prevented from directly wetting the engine and its electric equipment 6** and is frustrated from reaching the intake system.

When intake port 11 is constructed with two walls **9*a* and 9*b*, as in the embodiment thus far described (although it is sufficient to be constructed of a single wall), it provides a kind of labyrinth or baffle construction, so that the air stream's direction is partially changed before it reaches wall 9*b*. Water, if any, in the air will wet outer wall 9*b***, so that it is prevented from going farther into the cowling. Thus, water entry into the cowling can be still further reduced.

If the cowling is formed with cut portions, its strength is accordingly reduced, thereby undesirably reducing structural strength needed if the engine is to be tilted up by gripping the open portion of the intake duct with the hand of a driver. Therefore, a countermeasure would be required to increase the thickness of the cowling as a whole. This requirement can be met by the aforementioned dual wall construction without increasing the thickness.

As has been described an outboard engine intake duct according to the present invention is characterized in that a cowling has its upper side rear portion formed with an upwardly and rearwardly facing recess, which is covered by a cover plate. Both the right and left side walls forming said recess have their upper portions formed with an intake port in the vicinity of said cover plate. As a result, a considerable quantity of the water entrained in the air stream can be removed by impingement on the walls that form the recess before it enters the cowling through the intake port. Moreover, even if water left in the stream enters the cowling from the intake ports, it impinges upon the side walls and is prevented from being carried directly to the engine and its electric equipment. As a result, it is possible to eliminate engine troubles caused by the wetting of the engine with the water and to the section of the water into the intake system.

This invention is not to be limited by the embodiment shown in the drawings and described in the description, which is given by way of example, and not of limitation, but only in accordance with the scope of the appended claims.

We claim:

1. An intake duct for an outboard engine, said engine having a cowling atop it, said cowling having a recess in its rear top portion above said engine, a right and left first side wall for said recess, an opening at the rear of said recess, and a back wall opposed to said opening; and a cover plate covering and enclosing the top of said recess, and completing, with said cowling, said rear opening, each of said first side walls defining an intake port located along the top edge of said first side walls and below said cover plate, each said intake port extending for a substantial length at an upper elevation adjacent to said cover plate, and opening into said cowling in a direction lateral to said cowling; air flow into said recess flowing through said rear opening and impinging on said back wall, and then dividing to flow sidewardly, over said first side walls, and through said intake ports in a direction lateral to said cowling.

2. An intake duct according to claim 1 in which part of said cowling extends downwardly from said cover plate and is disposed laterally of said side wall, and laterally from said cowling, whereby water entrained in air which has passed through said intake ports impinges on said part and wets said part and therefore does not impinge on said engine.

3. An intake duct according to claim 1 in which an outer second sidewall is provided above and laterally outward from each said first-named side wall to cause a baffled flow of air.

4. An intake duct according to claim 3 in which said outer second sidewalls depend downwardly, and said first sidewalls extend upwardly.

5. An intake duct according to claim 1 in which said cover plate includes throttle portions that occlude portions of said recess rear opening.

6. An intake duct according to claim 5 in which part of said cowling extends downwardly from said cover plate and is disposed laterally of said sidewall, and laterally from said engine, whereby water entrained in air which has passed through said intake ports impinges on said part and wets said part and does not impinge on said engine.

* * * * *